US006286706B1

(12) United States Patent
Tucker

(10) Patent No.: US 6,286,706 B1
(45) Date of Patent: Sep. 11, 2001

(54) TRASH CAN WITH LINER HOLDER

(76) Inventor: Renwick Tucker, 4280 N. Blackstock Rd., Apt. 2, Spartanburg, SC (US) 29301

( * ) Notice: Subject to any disclaimer, the term of this patent is extended or adjusted under 35 U.S.C. 154(b) by 0 days.

(21) Appl. No.: 09/577,517

(22) Filed: May 24, 2000

(51) Int. Cl.[7] ..... B65D 25/14
(52) U.S. Cl. ..... 220/495.11; 220/908.1
(58) Field of Search ..... 220/495.11, 495.1, 220/908.1

(56) References Cited

U.S. PATENT DOCUMENTS

| | | | | |
|---|---|---|---|---|
| 3,780,403 | | 12/1973 | Mauritz . | |
| 4,027,774 | * | 6/1977 | Cote | 220/495.11 |
| 4,630,752 | | 12/1986 | DeMars . | |
| 4,735,340 | | 4/1988 | Preston . | |
| 4,834,260 | * | 5/1989 | Auten | 220/495.11 |
| 4,892,224 | | 1/1990 | Graham . | |
| 5,100,087 | * | 3/1992 | Ashby | 220/495.11 |
| 5,125,605 | | 6/1992 | Guerrera . | |
| 5,222,704 | | 6/1993 | Light . | |
| 5,261,553 | * | 11/1993 | Mueller et al. | 220/495.11 |
| 5,419,452 | | 5/1995 | Mueller et al. . | |
| 5,636,416 | * | 6/1997 | Anderson | 220/495.11 |
| 5,711,563 | | 1/1998 | Sapp . | |
| 5,732,845 | * | 3/1998 | Armacy, Jr. | 220/495.11 |
| 5,735,495 | | 4/1998 | Kubota . | |
| 5,887,748 | | 3/1999 | Nguyen . | |

* cited by examiner

*Primary Examiner*—Joseph M. Moy
(74) *Attorney, Agent, or Firm*—Dority & Manning, PA

(57) ABSTRACT

A trash container liner holder is provided along an exterior of a trash can. The liner holder apparatus has a knob-like cleat around which is looped a gathered portion of the liner. A loose end of the gathered liner is then attached to a nearby clip, thereby preventing the liner from falling into the associated container as material is deposited into the container.

13 Claims, 3 Drawing Sheets

TRASH CAN WITH LINER HOLDER

FIELD OF THE INVENTION

This invention is directed towards a trash can or similar waste receptacle which has a securement device for retaining a bag liner in position around the opening of the waste receptacle.

BACKGROUND OF THE INVENTION

Disposable liners are frequently used with trash receptacles to facilitate the removal of trash. Further, the liners protect the receptacle and surrounding areas from becoming soiled and are safer for custodial staff to remove than is refuse in unlined receptacles.

A reoccurring problem with the use of disposable plastic liners is that the weight of accumulated trash or the forceful addition of an heavy item will cause the liner/bag to partially or completely slip inside the waste receptacle. Often, trash continues to be added to the container which defeats the purpose of having a liner present. In turn, removal of the trash is made more difficult.

Frequently, a liner bag is tied or knotted into position around the rim of the waste receptacle. However, such knots frequently slip. Further, the knots require that an excess length of the liner be available for use in the knot or tie.

A variety of retaining hoops, spring clips, brackets, support devices, fastening devices, have been developed in an effort to maintain a trash bag or liner in a secured position relative to the waste receptacle. Such teachings are reflected in the following U.S. Patents which are incorporated herein by reference.

| U.S. Pat. No. | Title |
|---|---|
| 3,780,403 | Spring Clip |
| 4,630,752 | Trash Can Hoop Retainer |
| 4,735,340 | Trash Bag Bracket |
| 4,892,224 | Support Device For A Disposable Trash Bag |
| 5,222,704 | Bag Support Device For Supporting A Bag Within A Trash Container |
| 5,419,452 | Fastening Device For Container Liners |
| 5,711,563 | Bagging Apparatus And Method |
| 5,735,495 | Trash Bag Holding Device |
| 5,887,748 | Bag Supporting System |

However, there remains room for improvement and variation within the art.

SUMMARY OF THE INVENTION

One aspect of the present invention is to provide a waste receptacle which has an external arm around which an upper edge of the liner is wrapped. Following the formation of a loop around the external arm, the free gathered portion of the liner is held in place by a clip.

Another aspect of the invention is to provide a wrapping structure such a cleat or handle around which a gather portion of a liner bag may be looped. The looping structure is carried along an upper external edge of the waste receptacle. A resilient clip or clamping member is in proximity to the wrapping structure and is used to secure the free bag edge which extends from the looping structure.

An additional aspect of this invention is to provide a process or method of installing and retaining a liner bag within a waste receptacle comprising the steps of:

providing a looping structure which projects from an exterior surface of a waste receptacle;

placing a liner within the receptacle;

pulling the upper liner tight against the waste receptacle rim;

gathering excess liner material from around the rim;

looping the gathered material around the looping structure; and, retaining the remaining gathered liner material within a clip carried along an exterior of the waste receptacle.

These and other features, aspects, and advantages of the present invention will become better understood with reference to the following description and appended claims.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings.

DESCRIPTION OF THE PREFERRED EMBODIMENT

Figure 1:
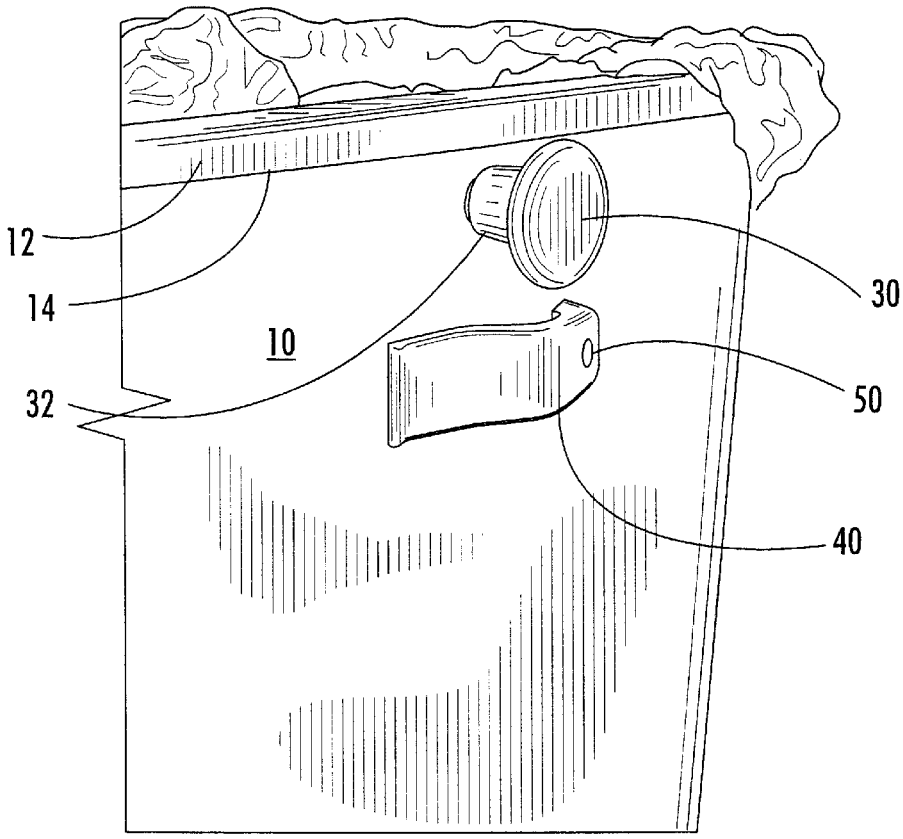
FIG. 1 is a perspective view of a waste receptacle in accordance with this invention.
Figure 2:
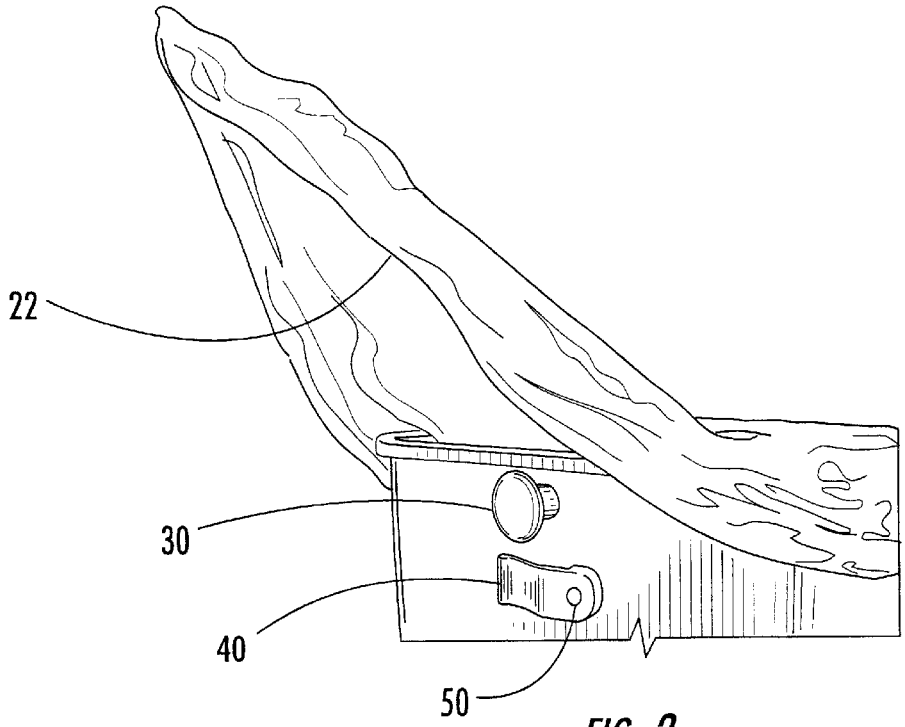
FIG. 2 is a perspective view of the receptacle of FIG. 1 setting forth additional details of the present invention in relation to a liner placed within the receptacle.
Figure 3:
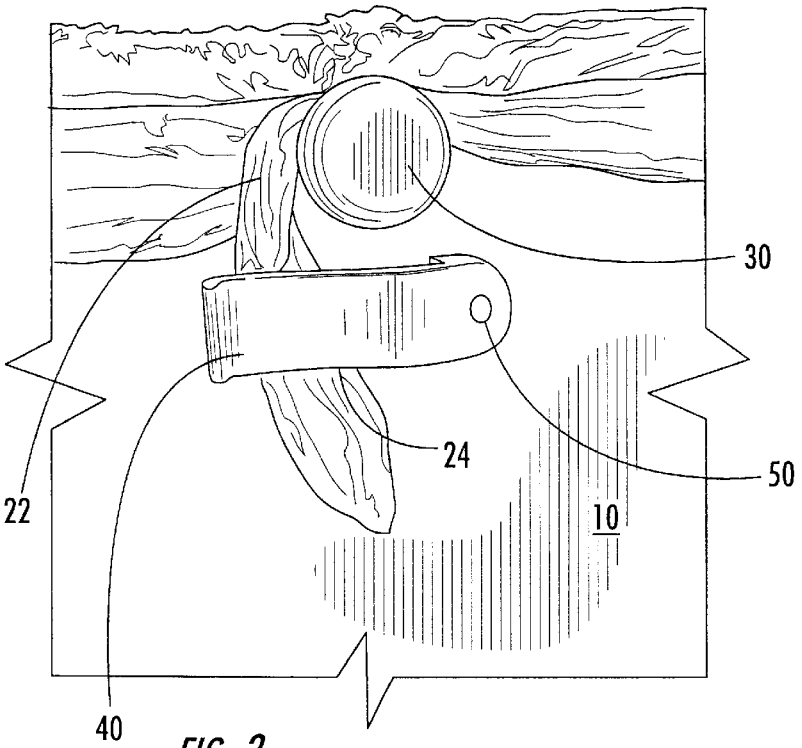
FIG. 3 is a front elevation of the waste receptacle set forth in FIGS. 1 and 2 setting forth additional details of the invention.
Figure 4:
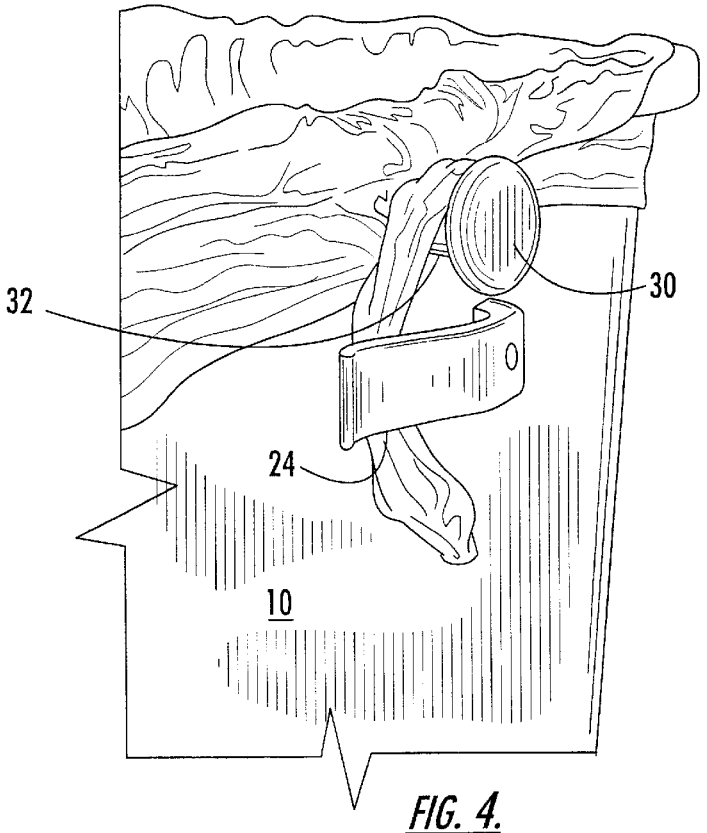
FIG. 4 is a side perspective view of the waste receptacle as seen in FIG. 3.

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. Other objects, features, and aspects of the present invention are disclosed in, or are readily apparent from, the following detailed description. It is to be understood by one of ordinary skill in the art that the present discussion is a description of exemplary embodiments only and is not intended as limiting the broader aspects of the present invention, which broader aspects are embodied in the exemplary constructions.

In describing the various figures herein, the same reference numbers are used throughout to describe the same apparatus or process. To avoid redundancy, detailed descriptions of much of the apparatus once described in relation to a figure is not repeated in the descriptions of subsequent figures, although such apparatus or process is labeled with the same reference numbers.

As best seen in reference to FIGS. 1–4, a first embodiment of the invention is provide by a trash receptacle 10 which may be in the form of any conventional office, residential, or yard waste receptacle for which plastic or mylar liners 20 are place within the interior of the receptacle 10. The receptacles 10 may be made of plastic, metal, wood, paperboard, or other conventional materials. A rim 12 typically is positioned along the receptacle opening and defines an outwardly extending lip 14.

A plastic liner 20, upon insertion into the receptacle 10, is pulled tight (FIG. 2) against the rim 12 of the receptacle 10. A first portion 22 of the excess gathered material is looped around a cleat 30 seen in FIGS. 1–4 in the form of a knob such as a hardware knob. Preferably, the free distal end of the cleat 30 defines a larger diameter or circumference than the interconnecting post 32. The larger diameter distal end helps retain the looped portion of liner 20 to cleat 30.

Once the gathered liner portion 22 is looped around the cleat 30, the remaining second portion 24 of the gathered material is secured to a nearby clip 40. Clip 40 may be provided by a spring clip, a tensioned leaf spring, or similar structure which holds the gathered material under tension against the exterior receptacle surface. Preferably, cleat 30 is less than one inch from the lip 12 or rim 14 of the receptacle. Clip 30 may be positioned within about 1–3 inches and more favorably within about 2 inches of the cleat. As illustrated, it may be useful to position the clip 40 so as to be positioned below the cleat 30.

Both clip 40 and cleat 30 may be integrally molded to the receptacle or may be attached to the receptacle 10 by any conventional fastener 50 apparatus or technique. Screws, rivets, or other mounting hardware may be used to secure the cleat 30 and clip 40 to or through the receptacle wall. Suitable adhesives may also be used to fasten either the cleat or the clip to the exterior of the receptacle 10.

It is useful to have cleat 30 extend substantially flush with and perpendicular to the exterior surface of the receptacle exterior. However, the cleat could be offset at an angle or non-flush configuration if desired.

Figure 5:
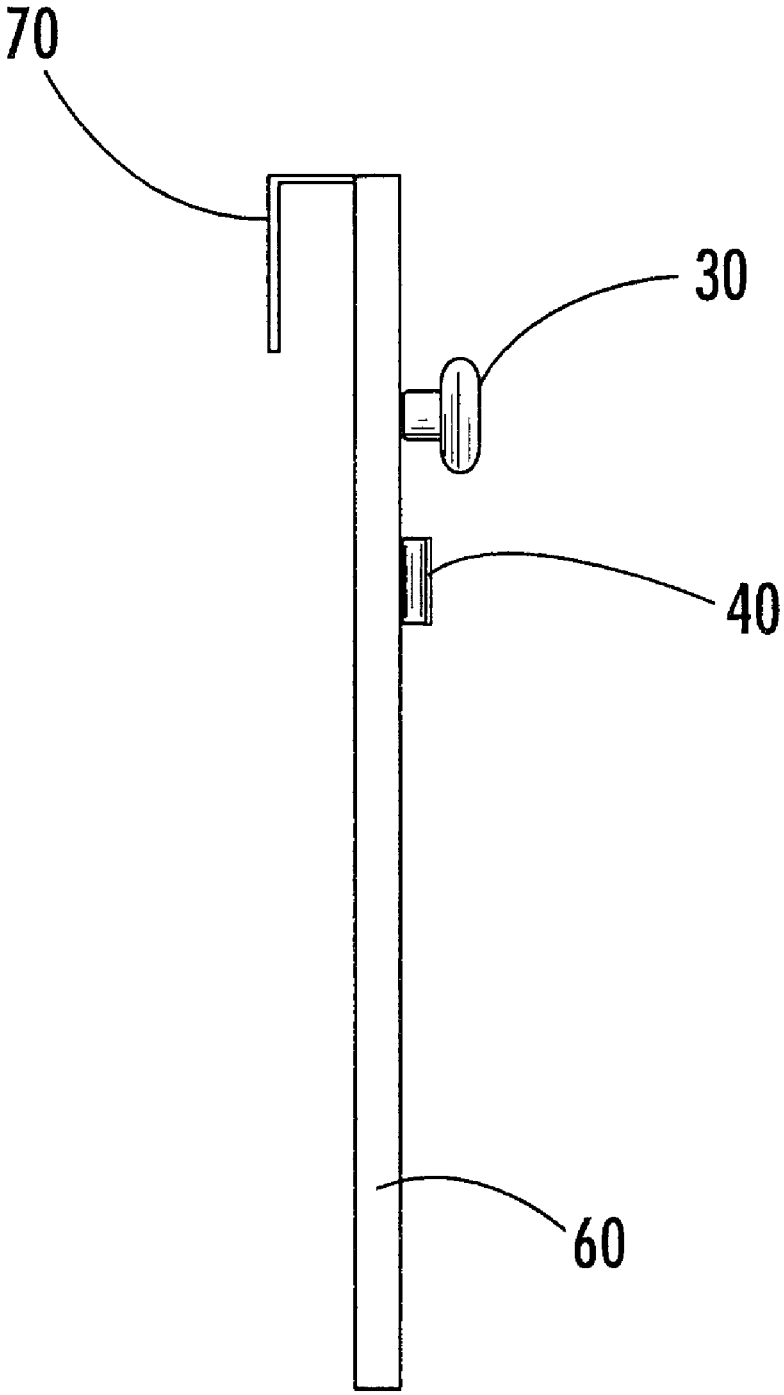
FIG. 5 is a side elevation of an alternative embodiment of the present invention which may be used with existing trash receptacles in accordance with this invention.

In addition, as seen in FIG. 5, the cleat 30 and clip 40 may be fastened to a flat panel member 60. Thereafter, panel member 60 may be operatively attached to the receptacle exterior using a conventional fastener or an adhesive bond. As seen in FIG. 5, an optional bracket 70 may be used to provide a reversible attachment sleeve which slips over the rim of the receptacle. Such an embodiment may be used to adapt a wide variety of existing receptacles with the cleat and clip members of the present invention.

If desired, the shape of the panel 60 may be arcuate in shape or otherwise complementary to the shape of the receptacle exterior.

The use of the cleat and clip has been found to substantially eliminate the disengagement of the liner from the receptacle rim. Further, the simple steps of gathering the excess liner material, wrapping the gathered material around the cleat, and securing the excess gathered liner with a clip provides for a rapid removal and installation of the liner. Further, the cleat and clip can be provided from a variety of materials and different aesthetic designs which are less obtrusive and more appealing than the elastic straps, cords, and devices heretofore used.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention, which is set forth in the following claims. In addition, it should be understood that aspects of the various embodiments may be interchanged, both in whole or in part. Therefore, the spirit and scope of the appended claims should not be limited to the description of the preferred versions contained therein.

What is claimed is:

1. A waste receptacle adapted for retaining a plastic liner about a rim of the receptacle comprising:

a waste receptacle having an interior, an exterior, and a rim surrounding an opening defined by the receptacle;

a cleat extending outwardly from an exterior surface of the receptacle;

a clip positioned in proximity to the cleat and adapted for retaining a portion of the liner adjacent the exterior surface of the waste receptacle;

wherein, when a plastic liner is place within the interior of the receptacle and the liner is gathered tightly against the rim, a portion of the gathered liner is wrapped around the cleat and a terminal portion of the gathered liner is secured by the clip.

2. The waste receptacle according to claim 1 wherein the cleat is attached directly to an exterior surface of the waste receptacle.

3. The waste receptacle according to claim 1 wherein the cleat defines a free terminal end having a larger circumference than an interior portion of the cleat.

4. The waste receptacle according to claim 1 wherein the clip is positioned below the cleat.

5. The waste receptacle according to claim 4 wherein the clip is positioned within about two inches of the cleat.

6. The waste receptacle according to claim 1 wherein the dip is attached directly to an exterior surface of the receptacle.

7. The waste receptacle according to claim 1 wherein the cleat further defines a circular knob.

8. The waste receptacle according to claim 2 wherein the clip is attached directly to the exterior surface of the waste receptacle.

9. A waste receptacle adapted for retaining a plastic liner about a rim of the receptacle comprising:

a panel having a front surface and an opposite back surface;

a cleat operatively engaged by a front surface of the panel;

a clip operatively engaged by a front surface of the panel, the clip positioned within about two inches of the cleat;

an attachment means for securing the panel to the waste receptacle;

wherein, when a plastic liner is place within the interior of the receptacle and the liner is gathered tightly against the rim, a portion of the gatherer liner is wrapped around the cleat and a terminal portion of the gathered liner is secured by the clip.

10. The waste receptacle according to claim 9 wherein the attachment means comprises an adhesive coating between the panel back surface and an exterior of the waste receptacle.

11. The waste receptacle according to claim 9 wherein the attachment means comprises a bracket secured to the panel and which is inserted over a rim edge of the waste receptacle.

12. The waste receptacle according to claim 9 wherein the attachment means further comprises a connector selected from the group comprising a rivet, a screw, a pin, and a nail.

13. A proccess of installing and retaining a liner bag within a waste receptacle comprising the steps of:

providing a looping structure which projects from an exterior surface of a waste receptacle;

placing a liner within the receptacle;

pulling the upper liner tight against the waste receptacle rim;

gathering excess liner material from around the rim;

looping the gathered material around the looping structure; and, retaining the remaining gathered liner material within a clip carried along an exterior of the waste receptacle.

* * * * *